United States Patent [19]

Jones et al.

[11] Patent Number: 4,615,913

[45] Date of Patent: Oct. 7, 1986

[54] MULTILAYERED CHROMIUM OXIDE BONDED, HARDENED AND DENSIFIED COATINGS AND METHOD OF MAKING SAME

[75] Inventors: Jack L. Jones, Colorado Springs, Colo.; Kenneth M. Chidester, Los Alamos, N. Mex.

[73] Assignee: Kaman Sciences Corporation, Colorado Springs, Colo.

[21] Appl. No.: 589,135

[22] Filed: Mar. 13, 1984

[51] Int. Cl.[4] ..... B05D 3/02; B05D 1/36; B05D 7/00

[52] U.S. Cl. ..... 427/226; 427/380; 427/419.2; 427/419.3

[58] Field of Search ..... 427/226, 380, 419.2, 427/419.3

[56] References Cited

U.S. PATENT DOCUMENTS

| | | | |
|---|---|---|---|
| 2,987,417 | 6/1961 | Cochran | 427/419.2 |
| 2,989,418 | 6/1961 | Harbugh | 427/419.2 |
| 3,299,325 | 1/1967 | Wagener et al. | 427/226 |
| 3,301,704 | 1/1967 | Zind | 427/226 |
| 3,501,337 | 3/1970 | Webb et al. | 427/255 |
| 3,585,260 | 6/1971 | Holker et al. | 427/226 |
| 3,717,467 | 2/1973 | Stradley et al. | 427/226 |
| 3,725,117 | 4/1973 | Caruso | 427/226 |
| 3,734,767 | 5/1973 | Church et al. | 427/226 |
| 3,789,096 | 1/1974 | Church et al. | 264/60 |
| 3,850,665 | 11/1974 | Plumat et al. | 427/226 |
| 3,869,312 | 3/1975 | Moss et al. | 427/419.2 |
| 3,873,344 | 3/1975 | Church et al. | 427/226 |
| 3,901,733 | 8/1975 | Toy et al. | 136/153 |
| 3,925,575 | 12/1975 | Church et al. | 427/226 |
| 3,944,683 | 3/1976 | Church et al. | 427/226 |
| 3,956,531 | 5/1976 | Church et al. | 427/226 |
| 3,985,916 | 10/1976 | Church et al. | 427/226 |
| 4,160,061 | 7/1979 | Okino et al. | 427/226 |
| 4,208,450 | 6/1980 | Lewis et al. | 427/419.2 |
| 4,382,104 | 5/1983 | Smith et al. | 427/226 |
| 4,495,907 | 1/1985 | Kamo | 427/230 |

*Primary Examiner*—John D. Smith
*Assistant Examiner*—Janyce A. Bell
*Attorney, Agent, or Firm*—Max L. Wymore

[57] ABSTRACT

This invention discloses a means of producing chromium oxide bonded coatings applied to metal or other suitable substrates in a layered, built-up manner and the products produced thereby.

33 Claims, No Drawings

MULTILAYERED CHROMIUM OXIDE BONDED, HARDENED AND DENSIFIED COATINGS AND METHOD OF MAKING SAME

Single layer chromium oxide bonded coatings applied to substrates have been disclosed earlier in U.S. Pat. Nos. 3,734,767; 3,789,096; 3,925,575; 3,944,683; 3,956,531; and, 4,007,020 by Church and Knutson also assigned to Kaman Sciences Corporation.

The coatings described in these earlier patents, and that are of interest in the present invention, typically are produced by applying a water based slurry containing one or more refractory oxides, nitrides, carbides, metals, etc., in finely divided form to a metal, ceramic or other suitable substrate. Also included in the slurry mix is a small amount of a water soluble inorganic binder. The coated substrate is then heated to a sufficiently high temperature to drive off the water and to convert the binder so as to establish preliminary bonding between the particulate matter comprising the coating layer and between this layer and the substrate.

This initially applied and thermally cured single coating is too soft for most any practical use at this point, as well as being quite porous. Such coating is, therefore, usually further bonded, densified, hardened and strengthened. As expained in the patents referenced above, this is accomplished by impregnating the single porous coating with a solution of a water soluble chromium compound capable of being converted in situ to a water insoluble chromium oxide. This impregnation-cure cycle procedure is repeated at least once and usually for a sufficient number of times to achieve the desired coating hardness and density. The additional impregnation and chromium oxide thermal cure conversions will also establish an extremely strong bond between the coating and substrate.

In the practice of these earlier patents, it has been found that there is a practical thickness limitation to which a single coating layer can be applied to a given substrate. Attempting to apply thicker coatings in a single application simply results in spalling or cracking of the coating, separation from the substrate or deformation of the substrate due at least in part to differences in thermal expansion.

The specific coating thickness limitation depends on many factors such as the thermal expansion coefficients of both the substrate and the coating, the coating particle size distribution, initial coating binder and subsequent impregnant used, the type of substrate, substrate contour and the surface finish to name but a few.

By way of example, a prior art single layer coating using a −325 mesh particle size combination of aluminum oxide and silica mixed with water and a water soluble chromium binder as the coating slurry can be applied to 1020 steel substrate to a thickness of only about 0.010"–0.015" and still retain an excellent bond to the substrate. This assumes from 10 to 12 impregnation-cure cycles of the coating using concentrated chromic acid as the impregnant and a suitable thermal cure temperature of about 1000° F.

Thicker coatings could be made using the earlier method by simply building up one chromium oxide bonded and densified layer upon another. However, such a method can require a very large number of impregnation-cure cycles if a number of layers are to be built-up in such a manner. Tests using this technique have also shown that relatively thin layers must be used if satisfactory bonding between layers is to be maintained.

According to the present invention, it has now been found that the prior art limitation is easily overcome by the forming of thick coatings by applying multiple coatings with one coating layer being applied over another using a preferred sequence of thermal curing, impregnation and coating slurry application. The multiple impregnation-cure cycling to obtain the desired hardness, bonding and densification of the entire coating is carried out after the layering has been built up to the desired final thickness.

Well bonded multi-layer coatings of this type, similar in other respects to the single layer example described earlier, can now be readily produced in coating thicknesses in excess of ¼". Experimental coatings having a thickness of ½" have been applied to a ⅛" diameter steel rod. No particular limitation in coating thickness is presently foreseen.

In the various practical applications of this invention, it should be pointed out that the individual coating layers may be identical but need not be. For example, steel piston heads for use in adiabatic engines, operating at high temperatures, can be coated so that the coating layers nearest the substrate provide maximum thermal insulating properties while the layers near the surface have maximum hardness and wear resistance.

Similarly, the layered construction can include not only variations in hardness and porosity between layers, but also considerable variation in the particle size and type of finely divided refractory coating material involved in the basic slurry applied in a given layer. In addition, burn-out material may be included in one or more layers as well as the formation of numerous metal/ceramic composite compositions. A burn-out material being one that will be burned at the cure temperature or below to provide voids within a body or layer. It is also contemplated that various reinforcing additions may be included in the applied coatings such as glass fibers, carbon fibers and the like.

DESCRIPTION OF THE INVENTION

This invention involves the application of a plurality of layers to provide multiple layered coatings which are applied to suitable substrates using the specified application sequence and processing method of this invention. The method is best described in a step-by-step manner as follows:

Basic Procedure (a) An initial coating layer is applied to a suitable substrate using a water based slurry made up of finely divided, particulate material and a suitable inorganic binder. The resulting slurry is applied on to the substrate surface using one of a number of available means such as dipping, brushing, spraying or flowing.

The coating substrate is usually allowed to air dry or may be heated to a temperature sufficiently high to drive off the water. The temperature is also sufficient to convert the inorganic binder so as to form a bond between the particulate coating materials and between the coating resulting and the substrate.

The coated substrate is then cooled to room temperature. While the coating will be quite porous at this stage, the bonding will be strong enough to withstand the next processing step.

(b) The initially coated substrate from step (a) is now wetted preferably with a water solution containing a soluble chromium compound.

Before significant evaporation of water can occur from the coating, and using an application method such as in step (a), a new slurry coating layer is applied over the just wetted previously applied coating layer. This new slurry coating may also contain a suitable soluble chromium compound.

The now re-coated substrate is again preferably air dried and is then heated as in step (a) but in this case taken to a temperature high enough to convert the soluble chromium compound to a chromium oxide where it acts as the coating binder.

The coated substrate is then again cooled to room temperature.

(c) A third layer and successive layers can similarly be applied as in step (b), making certain that the preceding layers are thermally cured, cooled and wetted.

(d) When the layered coating has been built-up to the desired thickness on the substrate, multiple impregnation-cure cycling is carried out using a water soluble chromium compound that can be thermally converted in situ to a binder of chromium oxide after each succeeding impregnation to achieve the desired hardness, bonding, strengthening, and densification of the built-up multi-layered coating.

The reason why thick multi-layered coatings can be built-up in the specific manner outlined above and still retain excellent coating-to-substrate bond strength, excellent thermal shock resistance and other related and desirable properties, while much thinner, single layer coatings will fail to make an adequate substrate bond, is not fully understood.

It is our present theory, however, that stress relieving, probably in the form of microcracking, is occurring within and between the coating layers. Also, the layers are being built-up gradually enough so that stresses are sufficiently relieved before the final, repeated impregnation-cure cycling and provides the desired densification, bonding, strengthening and hardening of the entire structure.

A more detailed description of the Basic Procedure given above for forming the multi-layered coatings of this invention will be made on an individual step basis. This will start with step (d) and then proceed to steps (a), (b) and (c). Also, examples of specific coatings made using this new method will also be included in our disclosure.

It should be stated that the final step (d) in the Basic Procedure may be the same and preferably is the same as that employed in bonding, densifying, strengthening and hardening single layer coatings as covered by the U.S. patents assigned to assignee referred to earlier.

The basic method described in these earlier applications, and that employed in the present disclosure consists of repeated impregnation-cure cycles of a porous body with a soluble chromium compound which is convertible in situ by heat to a water insoluble chromium oxide.

The term soluble chromium compound as used in this disclosure is intended to mean any of a large number of chromium impregnants or "binders" such as water solutions of: chromic anhydride ($CrO_3$), usually called chromic acid when mixed with water ($H_2CrO_4$); chromium chloride ($CrCl_3.xH_2O$); chromium nitrate [$Cr(NO_3)_3.6H_2O$]; chromium acetate ($Cr(OAC)_3.4H_2O$); chromium sulfate ($Cr_2(SO_4)_3.15H_2O$); etc. Also included are a wide variety of dichromates and chromates such as zinc dichromate; magnesium chromate; and, mixtures of chromates with chromic acid. A variety of more complex soluble chromium compounds is also included that can perhaps be best categorized by the generalized formula $xCrO_3.yCr_2O_3.xH_2O$ which are chromic chromate complexes as set forth in the American Chemical Society Monograph Series on Chromium, Volume 1, entitled "Chemistry of Chromium and Its Compounds," Marvin J. Udy, Reinhold Publishing Corporation, New York, New York, copyright 1956, page 292, wherein chromium is present both in a trivalent cationic state and in a hexavalent anionic state. These are normally prepared by reducing chromic acid with some other chemical such as tartaric acid, carbon, formic acid and the like. A second method is to dissolve $Cr_2O_3$ or $Cr_2O_3.xH_2O$ or chromium hydroxide in chromic acid. There is a limit of about 12%–15% Cr(III) that may be introduced in this later method due to the low solubility of $Cr_2O_3$ in the chromic acid solution.

In the first method of preparing these complex chromium compounds there also may not be a complete reaction. For example, a treatment of formic acid with chromic acid may result in some formate remaining. No quantative analyses have been performed and any remaining organic material will be oxidized and volatilized at some point during the heat cure cycle used following each impregnation cycle of the porous body.

Some of these binders such as chromic acid are extremely wetting. Others, such as the complex chromium compounds ($xCrO_3.yCr_2O_3.xH_2O$) can be prepared so as to contain large concentrations of chromium ions in solution and are not as wetting or as easily absorbed into a finely porous coating as say a concentrated chromic acid solution.

The soluble chromates have been found useful for achieving high hardness values in a few impregnation-cure cycles. These are also useful for filling bodies having a relatively large pore size structure whereas use of a compound such as chromium acetate might require several impregnation-cure cycles before achieving a noticeable increase in hardness.

Only the acidified soluble chromium compounds have been found to produce extremely hard bodies having improved strength. The basic and neutral solutions made by dissolving chromium binder compounds such as ammonium dichromate, potassium chromate and the like have not been found to produce any significant increase in hardness or strength. As a result these appear to be useful only for filling porosity and no bonding of the resultant oxide formed upon heating appears to be taking place within the porous body.

While many of these soluble chromium impregnants have been found to be useful, the preferred impregnants are chromic acid, combinations of chromates and chromic acid, or water soluble mixtures of the $xCrO_3.yCr_2O_3.xH_2O$. Among the chromates, zinc and magnesium have been the most frequent choices.

All of the chromium compounds are normally used in relatively concentrated form in order to achieve maximum chromium oxide bonding and densification. Dilute solutions may have a tendency to migrate toward the surface of a porous part causing a surface hardening condition. For certain applications, of course, this may be desirable. While in most cases water is used as the preferred solvent for the soluble chromium compounds, other solvents may be used in certain instances, such as various alcohols.

Upon curing to a temperature sufficient to convert the chromium compound to a water insoluble chromium oxide, preferably in excess of 600° F., and usually higher, all of these soluble chromium compounds described above for use as coating impregnants are converted to a water insoluble chromium oxide. For example, with increasing temperature chromic acid ($H_2CrO_4$) will first lose its water, and the chromium anhydride ($CrO_3$) that remains, will then as the temperature is further raised, begin to lose oxygen until at about 600° F. and higher, it will convert to chromium oxide of the refractory form ($Cr_2O_3$ or $Cr_2O_3.xH_2O$). The same situation exists for the partially reacted soluble, complex, chromic acid form ($xCrO_3.yCr_2O_3.xH_2O$) discussed earlier.

Chromium compounds such as the chlorides, sulfates, acetates, and the like, will also convert to $Cr_2O_3$ by heating to a suitable temperature. The chromates all require a higher temperature to convert to the oxide form (that is to a chromite or a chromite plus $Cr_2O_3$) than does chromic acid by itself. For the purposes of this disclosure, chromites are considered to be a chromium oxide even though they may also contain oxides other than chromium.

The maximum curing temperature is usually limited by the original coating particulate material or the substrate considerations. The chromium oxide forming the internal bonds and providing strengthening, hardening and densification to the system, has an extremely high melting temperature of as high as 3000° F. depending on the particular chromium impregnant used during processing and is usually not the limiting factor in this respect.

Considerable prior experimentation has shown that maximum hardness, bonding, strengthening and densification of a coating will be reached after about 12–13 immediately repeated impregnation-cure cycles when using a concentrated chromic acid solution (such as C-1.7 in Table I) as the impregnant. Applying additional such treatments has not been found to materially increase the hardness or related strength properties of any normally formulated coating.

In general, maximum densification of a particular coating can be achieved using fewer impregnation-cure cycles of a concentrated solution of a high chromate content mixture with chromic acid (such as ZC-2 in Table I) or an $xCr_2O_3.yCrO_3.xH_2O$ type solution (such as C-7 in Table I) than when using concentrated chromic acid. However, the chromic acid will normally provide higher hardness values.

In other tests, the use of a few of the high chromate content mixtures with chromic acid or the $xCr_2O_3.yCrO_3.zH_2O$ type impregnation-cure cycles and then switching to a chromic acid as the impregnant has often shown improved hardness and/or strength over that of chromic acid alone as the impregnant for all cycles. In other cases, it has not. It is believed that the initial pore sizes of the coating may play an important part as to the optimum impregnant system to be employed for the specific properties desired.

It is not uncommon to obtain surface hardness values for fully densified coatings of this type in the range of 1000–1200 on the 50 g Vickers hardness scale. Therefore, it may be desirable to rough grind or otherwise machine the surface of these multi-layer coatings prior to applying too many impregnation-cure cycles. If the maximum number of such cycles are used, diamond machining and lapping will be required.

There is disclosed in this application the fact that a great variety of materials can be bonded, densified, strengthened and hardened by means of the chromium compound-to-chromium oxide, multiple impregnation-cure cycle method according to the present invention. More specifically, we have found that virtually any material can be chrome oxide bonded provided: (1) it is either composed of an oxide, has an oxide constituent or will form a well-adhering oxide on its surface; (2) it is not soluble nor adversely reactive to the chromium compound employed as the impregnant; (3) it is inherently stable to at least the minimum heat cure temperature to be employed when converting the soluble chromium compound to a chromium oxide.

Therefore, the slurry coating initially applied to the substrate, as in the Basic Procedure step (a), can contain any of a large number of finely divided particulate materials in its composition.

The commonly employed refractory oxides are those of aluminum, silicon, zirconium, titanium, cerium, iron, and the like; however, many others can be employed. In addition, many non-oxide materials have been successfully used or would certainly make excellent choices for particular coating applications. Examples are many of the nitrides, carbides, silicides, borides, intermetallics, ferrites, metals and metal alloys, complex oxides and mixtures of any of these including mixtures with oxides. It is well known, for instance, that most metals form a very thin oxide layer on their surfaces when exposed to air. If not, such a layer will invariably be formed with the application of heat in an air or oxidizing atmosphere. The same holds true for silicon carbide, silicon nitride, boron carbide, molybdenum silicide, and the like where oxides of silicon, boron and so on are formed. In fact, most such materials do not exist without these thin protective oxide layers being present.

Included within the scope of coating constituents are the so-called complex oxides. As coating constituents used here, a complex oxide does not mean a mixture of discrete oxides but rather an identifiable chemical compound. Examples are "zircon" or zirconium silicate ($ZrSiO_4$ or $ZrO_2.SiO_2$), calcium titanate ($CaTiO_3$ or $CaO.TiO_2$), magnesium stannate ($MgSnO_3$ or $MgO.SnO_2$), cerium zirconate ($CeZrO_4$ or $CeO_2.ZrO_2$), etc. These materials, of course, act like oxides insofar as forming a chromium oxide bond according to the invention.

In addition, various fillers or burn-out materials can be included in the coating slurry such as hollow glass beads or polystyrene particles. Also many fine ceramics, metal or other type fibers can be added.

The initial water based coating slurry that is applied to the substrate in step (a) also must contain a sufficient amount of a suitable binder to effect a bond between the coating particulate material and to the substrate. While soluble chromium binders are normally used, other binders such as appropriate amounts of sodium silicate, phosphoric acid and the like can sometimes be used.

When using the preferred chromium type binder, this can be selected from among those soluble chromium compounds disclosed previously for use as impregnants in the final impregnation-cure cycling of the Basic Procedure, step (d). Unlike their use as impregnants, however, the coating slurries usually employ the soluble chromium compound(s) in a considerably more dilute form. This can be seen in Examples I through VI.

The initial coating mix or slurry can be applied to the substrate by any of various means such as dipping, brushing, flowing-on, or spraying with an air gun.

The coated substrate is then usually allowed to air dry and then placed in an appropriate oven or otherwise heated to a sufficiently high temperature to convert the binder to an essentially water insoluble form. In any event, sufficient binder should be employed so that the coating will be strong enough to withstand further processing. The cured coating will be found to be highly porous, of the interconnected type.

A wide variety of metals, alloys and refractory oxide materials have been found to make excellent substrates to which these chromium oxide bonded coatings can be applied. The substrates can also include nitrides, carbides, borides, silicides and certain other non-metal or non-oxide materials.

When coatings are bonded to non-oxide substrates such as metals, carbides, etc., it is believed that the chromium oxide bond is actually established to a thin oxide film that is usually inherent, or at least is subsequently formed, on the substrate during the initial heat-cure cycle.

Typical, more commonly used substrates for this coating process have included cast iron and low and high carbon steels. However, many other common metals and alloys can be used such as bronze alloys, high nickel and cobalt alloys, 400 and 300 series stainless steels, beryllium copper, titanium, and the like.

Aluminum alloys are less desirable substrates in most instances because of their low melting and distortion point and the even lower temperature at which their temper is effected. Metals or other materials that form poorly adhering oxides on their surface before or during processing also make poor substrate choices.

In accordance with the Basic Procedure step (b) of our invention, the second coating layer can now be added to the previously coated substrate. This involves wetting the previously cured first coating layer with a suitable impregnant and, before appreciable evaporation can occur, applying the second coating layer in slurry form. Again, the slurry can be laid down by spraying, dipping or other suitable means as previously explained.

The now wet, two-layered coating structure is again preferably allowed to air dry and is then heated to a temperature sufficiently high to convert the soluble chromium compound binder to a chromium oxide. As in step (a), the chromium oxide forms a bond between the particulate material in the newly applied coating, but in addition forms an excellent bond to the previously applied coating layer. Since both layers are still very porous in nature, there will be considerable intermingling and migration of the chromium compound between layers during these processing steps.

Because of the migration of the chromium compound between layers, the solution used to wet the cured initial coating layer can sometimes be water alone. In this case, the necessary inter-layer bonding will be furnished by the migration of the chromium compound contained in the newly applied, second slurry coating layer.

A third coating layer and additional coating layers can then be individually applied and thermally cured using the basic method just described for applying the second layer which is step (c) of the Basic Procedure.

The amount of soluble chromium compound used in the wetting solution appears to be somewhat dependent on the number of coating layers involved and also on the coating pore and grain size and the amount of chromium binder included in the newly applied slurry coating. Concentrated chromium compound wetting solutions can be successfully used in many instances. For example, in making extremely hard and dense coatings. In other situations, more dilute chromium wetting solutions or water alone may be preferable in order to form more porous or thicker coatings with fewer required layers.

Even though implied in the Basic Procedure, it is not always necessary to have a separate or independent wetting step prior to applying the next slurry coating layer. In special instances, the wetting solution can be supplied entirely from extra liquid in the just applied slurry coating. For example, successful multilayered coatings according to the invention have been prepared in this way with a spray gun using extra liquid by laying down the slurry coating in repeated passes over the previously non-wetted underlayer(s).

In most instances, however, such as in preparing dipped or conventionally sprayed coatings, the separate or independent wetting step is preferably used. This is because of the very strong capillary forces that exist in the cured underlayer(s). The resulting effect could be the removal of too much liquid and chromium binder from the just applied slurry layer, creating poorly bonded areas between the new and older surface layers, entrapping air between the layers and creating generally non-uniform coatings.

An alternative multilayered coating method, not discussed previously, is to use coating slurries containing water only, that is, with no chromium compound included in the slurry mix. In this case, the binder will be furnished by the migration of chromium compound from the underlayer(s) previously wetted with a soluble chromium compound solution.

A number of multilayered, chromium oxide bonded coatings according to the invention have been processed and are described below as examples in the use of this new method. These particular test samples have been selected to show variations in the coating formulation, application method, substrate material and processing steps.

Table I includes the various soluble chromium compound solutions specified in this disclosure and used at various concentration levels as impregnants, binders and wetting solutions. A brief description of their preparation method and specific gravity is also listed. Note that there may be alternate ways of preparing some of the solutions shown.

Table II shows the three slurry coating formulations selected for use in the test samples to be described.

Table III covers multilayered refractory oxide coatings built up on the inside surface of 1025 steel cylinders. Each cylinder measured 5½" in length with an i.d. of 2.5" and a wall thickness of 0.15". The inside was grit blasted to furnish a clean and somewhat roughened surface before applying the initial coating layer.

In this group of tests, each cylinder received five individual coating layers according to the Basic Procedure, steps (a) through (d) described earlier. That is, after each slurry application, the coating was air dried, thermally cured to convert the oxide to a water insoluble form, cooled to room temperature and then wetted with the specified solution before applying the next slurry layer. Each layer was applied using what has been termed as a drain coating method. This involves clamping the cylinder in an upright position against an O-ring seal and then slowly filling the coating slurry from the bottom. After the slurry has reached the top of the cylinder, it is then again slowly drained out leaving a uniformly thick layer on the inside surface. This is an alternative to a dip coating method. The coating slurry has been well mixed prior to use. The 5-layer coatings built up in each of these test cylinders used the type TBC formulation and mixing procedure described previously in Table II.

TABLE I

SOLUBLE CHROMIUM COMPOUNDS USED AS IMPREGNANTS, BINDERS & WETTING SOLUTIONS

| Symbol | Description | Formula | Materials For Preparation | Parts by Weight Additive | Preparation Procedure | Specific Gravity |
|---|---|---|---|---|---|---|
| C-1 | Chromic Acid | $H_2CrO_4$ | Chromium Trioxide ($CrO_3$) | — | Dissolve in $H_2O$ adding excess $CrO_3$. Let stand for about 1 day or more while the chromic acid solution polymerizes. Add additional $H_2O$ if required to adjust specific gravity. | 1.65–1.7 |
| C-7 | Soluble complex chromium compound | $xCrO_3.y$ $Cr_2O_3.z$ $H_2O$ | Chromium Oxide ($Cr_2O_3$ or $Cr_2O_3$. $xH_2O$) Chromium Trioxide | ≈210 ≈1812 | Add $CrO_3$ to $H_2O$ to make a concentrated solution. Heat solution to about 80° C. and slowly add $Cr_2O_3$ (Pigment grade) until dissolved. | 1.84 |
| ZC-2 | Zinc Dichromate | $ZnCr_2O7$ | Zinc Oxide (ZnO) Chromium Trioxide ($CrO_3$) | ≈40.7 ≈200 | Add $CrO_3$ to $H_2O$ to make a concentrated solution. Then add ZnO slowly until dissolved. | 1.65 |
| ZC-8 | Zinc Chromate Chromic Acid Mixture | $ZnCrO_4$ + $xCrO_3$ | Zinc Oxide (ZnO) Chromium Trioxide ($CrO_3$) | ≈40.7 ≈800 | Add $CrO_3$ to $H_2O$ to make a concentrated solution. Then add ZnO slowly until dissolved. | 1.65 |

TABLE II

SLURRY COATING FORMULATIONS

| Coating Type | Soluble Binder Solution Composition | Amount | Refractory Oxide Grain Materials | Amount | Slurry Specific Gravity |
|---|---|---|---|---|---|
| 0–85 | ZC-8[b] | 447 ml | $SiO_2$, −325 mesh[c] | 301 g | 1.9–2.0 |
| | $H_2O$[a] | 240 ml | $Al_2O_3$, −325 mesh[d] | 53 g | |
| TBC | ZC-8[b] | 447 ml | $SiO_2$, −325 mesh[c] | 300 g | 2.2–2.3 |
| | $H_2O$[a] | 240 ml | $Al_2O_3$, −325 mesh[d] | 60 g | |
| | | | $Cr_2O_3$, −200 + 80 mesh[e] | 180 g | |
| TBC-F2 | ZC-8[b] | 447 ml | $SiO_2$, −325 mesh[c] | 300 g | 2.2–2.3 |
| | $H_2O$[a] | 240 ml | $Al_2O_3$, −325 mesh[d] | 60 g | |
| | | | $CrO_3$, −200 + 80 mesh[e] | 180 g | |
| | | | $Al_2O_3$—$SiO_2$ fiber[f] | 5 Vol. % | |

Mixing Procedure:

1. Combine the ZC-8 solution with the $H_2O$ in a glass beaker or other suitable container.
2. Slowly add the refractory materials to the above solution while stirring with a motorized mixer turning at moderate speed. Mixing should continue until a uniform slurry consistency is obtained (normally 5–10 minutes).
3. Measure specific gravity of slurry by determining weight for known volume. Adjust to correct range by adding more ZC-8/$H_2O$ solution, or refractory materials in correct proportions, and thoroughly re-mix.
4. These mixed slurries will settle on standing but can be used again after thoroughly re-mixing. Should evaporation occur, add $H_2O$ to readjust specific gravity.

Notes:
[a]distilled or de-ionized water
[b]zinc chromate-chromic acid mixture - see TABLE I
[c]Silica Powder 325 mesh, 12μ average particle size, Chemical Spoors, Inc. Box 313, Prospect Heights, IL 60070
[d]aluminum oxide, tabular, −325 mesh, Aloa, Pittsburgh, PA 15219
[e]chromium oxide, +80–200 mesh, Norton Co., 1 New Bond Street, Worcester, MA 01606
[f]aluminum silicate fiber, Fiberfrax ® Carborundum Co., Insulation Div., Box 808, Niagara Falls, NY 14302

TABLE III

MULTI-LAYERED COATINGS APPLIED USING DRAIN TYPE METHOD TO I.D. SURFACE OF STEEL CYLINDERS

| Test[a] # | Substrate | Coating Type[b] | Wetting Solution Materials | Wetting Solution S.G. | Max. Cure Temp. | Thickness of Cured Coating at Layer Indicated (Approximate, Inches)[a] 1 | 2 | 3 | 4 | 5 | — | — | — | Final Treatment[c] | Remarks |
|---|---|---|---|---|---|---|---|---|---|---|---|---|---|---|---|
| 1 | 1020 Steel 5⅛" long X 2½" id X 2.8" o.d. | TBC | C-1[c] | 1.7 | 1050 F. | .005 | .006 | .008 | .020 | .030 | — | — | — | C-1, 4 cycles + C-4, 4 cycles | Excellent hard, dense coating. |
| 2 | 1020 Steel 5⅛" long X 2½" id X 2.8" o.d. | TBC | C-1[c] + $H_2O$[d] 1:1 by wt. | 1.35 | 1050 F. | .005 | .010 | .014 | .030 | .040 | — | — | — | C-1, 4 cycles + C-4, 4 cycles | Excellent coating - faster thickness |

TABLE III-continued

MULTI-LAYERED COATINGS APPLIED USING DRAIN TYPE METHOD TO I.D. SURFACE OF STEEL CYLINDERS

| Test[a] # | Substrate | Coating Type[b] | Wetting Solution Materials | Wetting Solution S.G. | Max. Cure Temp. | Thickness of Cured Coating at Layer Indicated (Approximate, Inches)[a] 1 | 2 | 3 | 4 | 5 | — | — | — | Final Treatment[c] | Remarks |
|---|---|---|---|---|---|---|---|---|---|---|---|---|---|---|---|
| | | | | | | | | | | | | | | | build up with layering than Test 1 |
| 3 | 1020 Steel $5\frac{1}{8}''$ long X $2\frac{1}{2}''$ id X 2.8" o.d. | TBC | $H_2O$[d] | 1.0 | 1050 F. | .005 | .017 | .035 | .060 | .082 | — | — | — | C-1, 4 cycles + C-4, 4 cycles | Excellent coating - very rapid thickness build up with layering - not as hard or dense as Test 1 and 2 |
| 4 | 1020 Steel $5\frac{1}{8}''$ long X $2\frac{1}{2}$ id X | TBC | None | — | 1050 F. | .005 | .015 | .045 | .100 | — | — | — | — | C-1, 4 cycles + C-4, 4 cycles | Holes in coating over entire i.d. area. When 3rd layer applied - coating separated from one of the two cylinders after curing of 4th layer. |

Notes:
[a]2 cylinders were coated on entire i.d. surface in each of the above tests. Thickness readings shown are the average of the two samples measured following the cure cycle indicated.
[b]See TABLE II for coating formulation.
[c]See TABLE I for chromium compound description.
[d]distilled or de-ionized water.

While the basic slurry formulation remained the same, the type of wetting solution used to soak each previously applied and thermally cured coating layer was changed in each of the four tests shown in Table III. The table also shows the variations in coating thickness that resulted from this single processing change. Tests 1 and 2 show the use of C-1 in the wetting solution composition. C-1 refers to the concentrated chromic acid solution described earlier in Table I. Test 3 used water as the wetting solution. Test 4 used no prior wetting.

After each slurry application, the cylinder was allowed to air dry for at least a half hour. They were then placed in an oven already operating at 250° F. and left at this temperature for about one hour. The oven control was then re-set to 1050° F., which takes about one hour for the oven to reach. The coated parts were maintained at 1050° F. for about one hour. The oven was then turned off and the door slightly opened, to accelerate cooling, until the oven temperature reached 300° F.–400° F. At this point the parts were removed from the oven and placed on the bench to cool to room temperature. The entire cooling process involved approximately three hours.

Once the five coating layers were built-up and cured, a further densification, bonding and hardening multicycle process was carried out similar to that used with thinner single layer coatings, step (d) of Basic Procedure. As shown in Table III, this final treatment consisted of 4 impregnation-thermal cure cycles using C-1 as the impregnant followed by 4 similar cycles using C-7, the latter being a chromium chromate impregnant also described in Table I for a total of 8 cycles. These impregnations were made by simply painting the solutions onto the coated surface until the surface appeared wet. Any excess liquid was then wiped off. Each of these 8 impregnations was followed by the same air drying, heating and cooling cycle described in the preceding paragraph.

As can be seen by referring to Table III, the coatings with the greatest amount of chromic acid used in the wetting solution were the thinnest after building up the five coating layers. However, due to the greater amount of chromium binder present, these were also the hardest and most dense coatings with a very strong coating-to-substrate bond. Using water alone as the wetting solution provided very rapid coating thickness build up. These could well be the best choice for thermal insulating and thermal shock resistant coatings where some internal porosity may be desirable. With no wetting of the previously applied coating, an even more rapid increase in coating thickness occurred. However, many holes and an uneven coating resulted by the time the third layer was applied. Excessive coating separation occurred after the fourth layer was cured. As discussed earlier, this failure was undoubtedly caused by the very strong capillary effects within the non-wetted layer(s) creating entrapped air and poor bonding between the old and newly applied layers.

Table IV describes multilayer coatings similar to those of Table III except in this case applied to flat steel surfaces. Also the coatings were applied using an air operated spray gun, rather than using the drain method of the previous examples. In these tests, the flat substrates measured $2'' \times 2'' \times \frac{1}{4}''$ and the coating was applied to one of the $2'' \times 2''$ surfaces after appropriate grit blasting. Again, all tests used the type TBC slurry coating formulation shown in Table II.

All tests shown in Table IV were made by building up the required number of coating layers to produce a final thickness of about 0.1". The principal difference between each of the 5 tests is the specific wetting solution used. It will also be noted in the table that, in general, the greater the amount of soluble chromium compound included in the wetting solution, the more coating layers that must be laid down to reach the 0.1" total thickness goal. Similar data in Table III indicates this same trend.

These coatings were also applied following the Basic Procedure, steps (a) through (d) and, after each slurry application, used the identical air drying, thermal cure and cooling cycles described earlier for the Table III tests. The final treatment processing was also the same as that of Table III.

All Table IV tests, however, were made using spray applied coatings. The initial layer is simply sprayed directly on the grit blasted substrate surface. Care is taken to apply the slurry as uniformly in thickness as possible. This initial layer was usually kept relatively thin (e.g., about 0.005" for this TBC slurry formulation) so that very little excess slurry binder solution, see Table II, remains on the surface of the particulate material just laid down. Successive slurry layers must be applied even more carefully, making several repeat passes with the spray mix so as to build up the coating gradually. Spraying was again stopped when the surface was just seen to become slightly wet in appearance.

These precautions will assure that any entrapped air in the previous coating layer(s) can have a chance to escape without causing air pockets or separation. It also assures wetting of the sub-layers. This gradual layering technique is especially important when spraying a slurry on a previously non-wetted coating such as shown in test 5 of Table IV. In such a case, all the wetting solution must be supplied from the slurry as it is being applied, as extremely high capillary forces can come into play.

Table IV shows that a wide variety of multilayered coatings can be made using these procedures. The spray technique has the additional advantage over many other types of slurry application methods (such as the drain method of Table III) in that the wetting of the prior layer(s) can also be supplied from the spray mix. This has been shown to allow thick and rapid coating build up for specific uses. Such coatings, for example, are presently being evaluated as "thermal barrier coatings" in new adiabatic diesel engine designs.

Table V shows additional multilayered coatings applied to flat substrates and includes special variations not previously shown. Tests A and B used 316 stainless steel, instead of the previously used low carbon steel, but in other respects were processed in virtually the same manner as the tests just described in Table IV. Test B did, however, use a different wetting solution. Test C was also processed in the same manner as the tests covered in Table IV except that the maximum cure temperature used during both the curing of the slurry layers and the final treatment processing was reduced to 1000° F. The wetting solution used in Test C between slurry coating applications was a chromium-chromate (C-7) water solution which had not been used previously. Tests A, B and C all resulted in excellent, well bonded and hard surfaced coatings.

TABLE IV

MULTI-LAYERED COATINGS APPLIED USING SPRAY GUN METHOD TO FLAT STEEL SURFACES AND BUILT UP TO A THICKNESS OF APPROXIMATELY 0.1"

| Test[a] # | Sub-strate | Coating Type[b] | Wetting Solution Materials | Wetting Solution S.G. | Max. Cure Temp. | Thickness of Cured Coating at Layer Indicated (Approximate, Inches)[a] 1 | 2 | 3 | 4 | 5 | 6 | 7 | 8 | Final Treat-ment[c] | Remarks |
|---|---|---|---|---|---|---|---|---|---|---|---|---|---|---|---|
| 1 | 1018 Steel (2" × 2" × ¼") | TBC | C-1[c] | 1.7 | 1000 F. | .006 | .017 | .028 | .040 | .055 | .072 | .082 | .104 | C-1, 4 cycles + C-7, 4 cycles | Excellent, hard dense coating |
| 2 | 1080 Steel (2" × 2" × ¼") | TBC | ZC-8[c] | 1.65 | 1000 F. | .006 | .017 | .028 | .039 | .095 | .072 | .083 | .098 | C-1, 4 cycles + C-7, 4 cycles | Excellent, hard dense coating |
| 3 | 1018 Steel (2" × 2" × ¼") | TBC | C-1[c] + $H_2O$ 1:1 by wt. | 1.54 | 1000 F. | .006 | .020 | .045 | .061 | .075 | .102 | — | — | C-1, 4 cycles + C-7, 4 cycles | Excellent coating - faster thickness build up with layering than Tests 1 & 2 |
| 4 | 1018 Steel (2" × 2" × ¼") | TBC | $H_2O$[d] | 1.0 | 1000 F. | .006 | .023 | .070 | .096 | .125 | — | — | — | C-1, 4 cycles + C-7, 4 cycles | Excellent coating - very rapid build up with layering - not as hard or dense as Tests 1, 2 or 3 |
| 5 | 1018 Steel (2" × 2" ×) | TBC | None | — | 1000 F. | .006 | .035 | .060 | .117 | — | — | — | — | C-1, 4 cycles + C-7, 4 cycles | Excellent coating - similar to Test 4 in respect to thickness build up and density of structure - requires special care in layering |

TABLE IV-continued

| Test[a] # | Substrate | Coating Type[b] | Wetting Solution Materials | Wetting Solution S.G. | Max. Cure Temp. | Thickness of Cured Coating at Layer Indicated (Approximate, Inches)[a] 1 | 2 | 3 | 4 | 5 | 6 | 7 | 8 | Final Treatment[c] | Remarks |
|---|---|---|---|---|---|---|---|---|---|---|---|---|---|---|---|
| | | | | | | | | | | | | | | | of slurry |

MULTI-LAYERED COATINGS APPLIED USING SPRAY GUN METHOD TO FLAT STEEL SURFACES AND BUILT UP TO A THICKNESS OF APPROXIMATELY 0.1"

Notes:
[a]2 substrates were coated on one 2" × 2" flat surface in each of the above tests. Thickness readings shown are the average of the two samples measured following the cure cycle indicated.
[b]See TABLE II for slurry coating formulations.
[c]See TABLE I for soluble chromium compound description.
[d]distilled or de-ionized water

TABLE V

OTHER MULTI-LAYERED COATINGS APPLIED USING SPRAY GUN METHOD TO FLAT SUBSTRATES

| Test[a] # | Substrate | Coating Type[b] | Wetting Solution Materials | Wetting Solution S.G. | Max. Cure Temp. | Thickness of Cured Coating at Layer Indicated (Approximate, Inches)[a] 1 | 2 | 3 | 4 | 5 | 6 | 7 | 8 | Final Treatment[c] | Remarks |
|---|---|---|---|---|---|---|---|---|---|---|---|---|---|---|---|
| A | 316 Stainless Steel (1½" × 1½" × 3/16") | TBC | None | — | 1000 F. | .007 | .018 | .033 | .068 | .102 | .114 | — | — | C-1, 4 cycles + C-7, 4 cycles | Similar to Test 5, TABLE IV except applied in slightly thinner layers |
| B | 316 Stainless Steel (1½" × 1½" × 3/16") | TBC | ZC-8[c] $H_2O$[d] 2:1 by wt. | 1.45 | 1000 F. | .004 | .020 | .040 | .050 | .082 | .117 | — | — | C-1, 4 cycles + C-7, 4 cycles | Similar to Test 3, in TABLE IV |
| C | 1018 Steel 2" × 2" × ¼" | TBC | C-7[c] + $H_2O$[d] 2:1 by wt. | 1.54 | 1000 F. | .006 | .020 | .032 | .048 | .063 | — | — | — | C-1, 4 cycles + C-7, 4 cycles | Similar to Test 3 in TABLE IV except slower thickness build up due to smaller water content in wetting solution. |
| D | 1018 Steel 2" × 2" × ¼" | 0-85 | None | — | 950 F. | .005 | .010 | .015 | .025 | — | — | — | — | C-1, 12 cycles | Very hard, dense, well bonded coating |
| E | 1018 Steel 2" × 2" × ¼" | TBC-F2 | $H_2O$[d] | 1.0 | 1050 F. | .007 | .020 | .060 | — | — | — | — | — | C-1, 1 cycle | Fairly porous coating designed for thermal insulating application |

Notes:
[a]2 samples prepared in Test A & B, 3 in Test C, 4 in Test D and 1 in Test E. Thickness readings shown are averages measured following the cure cycle indicated.
[b]See TABLE II for slurry coating formulations.
[c]See TABLE I for soluble chromium compound description.
[d]distilled or de-ionized water Test D used a type 0-85 slurry coating formulation. This contains finer particulate material than the TBC formulation used in the preceding tests described so far. See Table II for formulation composition. The processing of the Test D coatings was also somewhat different than that described for the earlier test examples above. After each new slurry application, the coating was air dried for at least a half hour or more. The dried coating was then heated in an oven for 2 hours at 200° F., then for 2 hours at 350° F. at which point the temperature was increased to 950° F. where it was held for 1 hour before being cooled slowly to room temperature. The final treatment processing used this same air drying, thermal curing and cooling procedure. However, 12 chromic acid (C-1) treatments were separately applied and thermally cured rather than the 4 cycles of C-1 followed by 4 cycles of C-7 used in the previously described test examples. Some of these Test D coatings were lapped after the 5th impregnation-thermal cure cycle to provide a smooth flat surface. Final hardness measurements were then made on the coating surface and found to read between 800 and 1000 on the 100 gm Vickers scale.

Test E is a special formulation in which ceramic fibers were added to a refractory oxide mix in order to provide added strength and bulk to a multilayered insulating type coating. This coating used formulation TBC-F2, as shown in Table II, which consists of 3 coating layers. Processing was the same as that specified for the tests in Table III.

It is believed that many special multilayered coatings using the basic method of this invention will find numerous useful applications. These should include coatings designed with layers of different compositions, the use of burn out materials to provide increased porosity, metal-ceramic composite mixtures, fiber containing composites and the like.

While there have been described what at present are considered to be the preferred embodiments of this invention, it will be obvious to those skilled in the art that various changes and modifications may be made therein without departing from the invention. It is aimed, therefore, in the appended claims to cover all such changes and modifications which fall within the true spirit and scope of the invention.

What is claimed is:

1. A method of producing a multiple layered relatively thick chemically hardened refractory coating on a substrate at least the surface of which is a refractory oxide having a vitrification temperature in excess of 600° F. which comprises:

(a) applying an initial coating layer to the substrate comprised of a slurry of a finely divided, particulate refractory material at least the surface of which is a refractory oxide and a solution of a suitable inorganic binder which is capable of being converted to an oxide on being heated;

(b) drying and curing said applied coating by heating same to a temperature below the vitrification temperature of the refractory material but sufficient to convert the binder in situ to an oxide to harden and densify the coating;

(c) impregnating the initial hardened coating with a solution containing an effective amount of a chromium compound which is capable of being converted to a water insoluble oxide on being heated and characterized by:

(d) applying, to the impregnated coating, a second coating layer of a slurry of a finely divided particulate refreactory material at least the surface of which is a refractory oxide and a solution of a suitable inorganic binder which is capable of being converted to a water insoluble oxide on being heated;

(e) drying and curing the slurry coating by heating same to a temperature below the vitrification temperature of the refractory oxide but sufficient to convert the chromium compound in situ to a water insoluble oxide; and, (f) repeating the impregnation step (c) before coating, then coating (d) and curing (e) and repeating the impregnating (c), coating (d) and curing (e) steps unitl a desired thickness multiple layered coating is achieved.

2. The method of claim 1 wherein the binder is a chromium compound.

3. The method of claim 1 wherein the binder is a chromic acid.

4. The method of claim 1 including the further steps of:

(g) impregnating the multilayered coating with a solution of a water soluble chromium compound capable of being converted to chromium oxide on being heated;

(h) drying and curing said impregnated coating by heating same to a temperature sufficient to convert the chromium compound in situ to chromium oxide; and, (i) repeating the impregnation and curing steps (g, h, i) at least once to densify, harden and strengthen at least the surface of the coating.

5. The method of claim 1 wherein the refractory material is comprised of materials selected from the group consisting of nitrides, carbides, silicides, borides, intermetallics, stannates, zirconates, titanates, borocarbides, silicates, ferrites, metals, metal alloys, oxides, complex oxides and mixtures thereof; is insoluble in and non-adversely reactive with the solution of a chromium compound selected as an impregnant; and is inherently temperature stable to at least the minimum heat cure temperature employed in converting the chromium compound impregnant, to chromium oxide.

6. The method of claim 1 wherein the binder is selected from the group consisting of a water soluble chromium compound, sodium silicate; and phosphoric acid.

7. The method of claim 1 wherein the refractory material is either composed of an oxide, has an oxide constituent or will form a well-adhering oxide on its surface; is not soluble nor adversely reactive to the chromium compound employed as the impregnant; and, it is inherently stable to at least the minimum heat cure temperature to be employed when converting the soluble chromium compound to a chromium oxide.

8. A method of producing a multiple layered relatively thick chemically hardened refractory coating on a substrate at least the surface of which is a refractory oxide having a vitrification temperature in excess of 600° F. which comprises:

(a) applying an initial coating layer to the substrate comprised of a slurry of a finely divided, particulate refractory material at least the surface of which is a refractory oxide and a solution of a suitable inorganic binder which is capable of being converted to an oxide on being heated;

(b) drying and curing said applied coating by heating same to a temperature below the vitrification temperature of the refractory material but sufficient to convert the binder in situ to an oxide to harden and densify the coating;

(c) impregnating the initial hardened coating with a solution containing an effective amount of a chromium compound which is capable of being converted to an oxide on being heated;

(d) applying a second coating layer of refractory material at least the surface of which is a refractory oxide and a water slurry to the impregnated coating on the substrate;

(e) drying and curing the slurry coating by heating same to a temperature below the vitrification temperature of the refractory oxide but sufficient to convert the chromium compound in situ to an oxide; and, (f) repeating the impregnation step (c) before coating, then coating (d) and curing (e) and repeating the impregnating (c), coating (d) and curing (e) steps until a desired thickness multiple layered coating is achieved.

9. The method of claim 8 wherein the binder is a chromium compound.

10. The method of claim 8 wherein the binder is a chromic acid.

11. The method of claim 8 including the further steps of:

(g) impregnating the multilayered coating with a solution of a water soluble chromium compound capable of being converted to chromium oxide on being heated;

(h) drying and curing said impregnated coating by heating same to a temperature sufficient to convert the chromium compound in situ to chromium oxide; and, (i) repeating the impregnation and curing steps (g, h, i) at least once to densify, harden and strengthen at least the surface of the coating.

12. The method of claim 8 wherein the refractory material is comprised of materials selected from the group consisting of nitrides, carbides, silicides, borides, intermetallics, stannates, zirconates, titanates, borocarbides, silicates, ferrites, metals, metal alloys, oxides, complex oxides and mixtures thereof, is insoluble in and non-adversely reactive with the solution of a chromium compound selected as an impregnant; and is inherently temperature stable to at least the minimum heat cure temperature employed in converting the chromium compound impregnant, to chromium oxide.

13. The method of claim 8 wherein the binder is selected from the group consisting of a water soluble chromium compound, sodium silicate; and, phosphoric acid.

14. The method of claim 8 wherein the refractory material is either composed of an oxide, has an oxide constituent or will form a well-adhering oxide on its surface; is not soluble nor adversely reactive to the chromium compound employed as the impregnant; and, it is inherently stable to at least the minimum heat cure temperature to be employed when converting the soluble chromium compound to a chromium oxide.

15. A method of producing a multiple layered relatively thick chemically hardened refractory coating on a substrate at least the surface of which is a refractory oxide having a vitrification temperature in excess of 600° F. which comprises:

(a) applying an initial coating layer to the substrate comprised of a slurry of a finely divided, particulate refractory material at least the surface of which is a refractory oxide and a solution of a suitable inorganic binder which is capable of being converted to an oxide on being heated;

(b) drying and curing said applied coating by heating same to a temperature below the vitrification temperature of the refractory material but sufficient to convert the binder in situ to an oxide to harden and densify the coating;

(c) impregnating the initial hardened coating with water;

(d) applying a second coating layer of particulate refractory material at least the surface of which is a refractory oxide and a solution containing an effective amount of a chromium compound as a slurry to the water impregnated coating on the substrate;

(e) drying and curing the slurry coating by heating same to a temperature below the vitrification temperature of the refractory oxide but sufficient to convert the chromium compound in situ to a water insoluble oxide; and, (f) repeating the impregnation step (c) before coating, then coating (d) and curing (e) and repeating the impregnating (c), coating (d) and curing (e) steps until a desired thickness multiple layered coating is achieved.

16. The method of claim 15 wherein the binder is a chromium compound.

17. The method of claim 15 wherein the binder is a chromic acid.

18. The method of claim 15 including the further steps of:

(g) impregnating the multilayered coating with a solution of a water soluble chromium compound capable of being converted to chromium oxide on being heated;

(h) drying and curing said impregnated coating by heating same to a temperature sufficient to convert the chromium compound in situ to chromium oxide; and, (i) repeating the impregnation and curing steps (g, h, i) at least once to densify, harden and strengthen at least the surface of the coating.

19. The method of claim 15 wherein the refractory material is comprised of materials selected from the group consisting of nitrides, carbides, silicides, borides, intermetallics, stannates, zirconates, titanates, borocarbides, silicates, ferrites, metals, metal alloys, oxides, complex oxides and mixtures thereof, is insoluble in and non-adversely reactive with the solution of a chromium compound selected as an impregnant; and is inherently temperature stable to at least the minimum heat cure temperature employed in converting the chromium compound impregnant, to chromium oxide.

20. The method of claim 15 wherein the binder is selected from the group consisting of a water soluble chromium compound, sodium silicate; and, phosphoric acid.

21. The method of claim 15 wherein the refractory material is either composed of an oxide; has an oxide constituent or will form a well-adhering oxide on its surface; is not soluble nor adversely reactive to the chromium compound employed as the impregnant; and, it is inherently stable to at least the minimum heat cure temperature to be employed when converting the soluble chromium compound to a chromium oxide.

22. The method of claim 1 wherein the chromium compound is a combination of a chromate and chromic acid.

23. The method of claim 8 wherein the chromium compound is a combination of a chromate and chromic acid.

24. The method of claim 15 wherein the chromium compound is a combination of a chromate and chromic acid.

25. A method of producing a multiple layered chemically hardened refractory coating on a substrate at least the surface of which is a refractory oxide having a vitrification temperature in excess of 600° F. which comprises:

(a) applying an initial coating layer to the substrate comprised of a slurry of finely divided, particulate refractory material at least the suface of which is a refractory oxide and a solution of a suitable inorganic binder which is capable of being converted to a water insoluble oxide on being heated;

(b) drying and curing said applied coating by heating same to a temperature below the vitrification temperature of the refractory material but sufficient to convert the binder in situ to an oxide to harden and densify the coating;

(c) impregnating the initial hardened coating with a liquid comprising water; and characterized by:

(d) applying, to the impregnated coating on the substrate, a second coating layer of a slurry of a finely divided, particulate refractory material, at least the surface of which is a refractory oxide, and a solution of a suitable inorganic binder which is capable of being converted to a water insoluble oxide on being heated;

(e) drying and curing the slurry coating by heating same to a temperature below the vitrification temperature of the refractory oxide but sufficient to convert the binder in situ to a water insoluble oxide; and, (f) repeating an impregnation-coating-curing cycle comprising, in sequence, the impregnation step (c), the coating step (d) and the curing step (f), until a multiple layered coating of a desired thickness is achieved.

26. A method according to claim 25, wherein the impregnation step (c) is carried out simultaneously with the coating step (d), the said slurry providing the necessary liquid for impregnating the surface of the initial hardened coating.

27. A method according to claim 25, wherein the impregnation step (c) in at least one cycle comprises impregnation with a solution containing a soluble chromium compound binder which is capable of being converted to a water insoluble oxide on being heated in the subsequent curing step.

28. A method of producing a multiple layered chemically hardened refractory coating on a substrate at least the surface of which is a refractory oxide having a vitrification temperature in excess of 600° F., which comprises:

(a) applying an initial coating layer to the substrate comprised of a water based slurry of a finely divided, particulate refractory material at least the surface of which is a refractory oxide;

(b) drying and curing said applied coating by heating same to a temperature below the vitrification temperature of the refractory material;

(c) impregnating the initial coating with a solution containing a soluble chromium compound binder which is capable of being converted to a water insoluble oxide on being heated; and characterized by:

(d) applying, to the impregnated coating on the substrate, a second coating layer of a water based slurry of a finely divided particulate refractory material at lest the surface of which is a refractory oxide;

(e) drying and curing the slurry coating by heating same to a temperature below the vitrification temperature of the refractory oxide but sufficient to convert the chromium compound binder to a water insoluble oxide; and, (f) repeating an impregnation-coating-curing cycle comprising, in sequence, the impregnation step (c), the coating step (d) and the curing step (e), until a multiple layered coating of a desired thickness is achieved.

29. A method according to claim 25, wherein each impregnation step is immediately preceded by cooling the coated substrate substantially to room temperature.

30. A method according to claim 25, the comprising the further steps of:

(g) impregnating the multilayered coating with a solution of a water soluble chromium compound capable of being converted to chromium oxide on being heated;

(h) drying and curing said impregnated coating by heating same to a temperature sufficint to convert the chromium compound in situ to chromium oxide; and, (i) repeating the impregnation and curing steps (f), (g) at lest once to densify, harden and strengthen at least the surface of the coating.

31. A method according to claim 25, wherein the refractory material is comprised of materials selected from the group consisting of nitrides, carbides, silicides, borides, intermetallics, stannates, zirconates, titanates, borocarbides, silicates, ferrites, metals, metal alloys, oxides, complex oxides and mixtures thereof; is insoluble in and non-adversely reactive with the solution of a chromium compound selected as an impregnant; and is inherently temperature stable to at least the minimum heat cure temperature employed in converting the chromium compound impregnant, to chromium oxide.

32. A method according to claim 25, wherein the binder in the slurry used in at least one of the coating steps is selected from the group consisting of a water soluble chromium compound, sodium silicate, and phosphoric acid.

33. A method of producing a multiple layered relatively thick chemically hardened refractory coating on a substrate at least the surface of which is a refractory oxide having a vitrification temperature in excess of 600° F. which comprises:

(a) applying an initial coating layer to the substrate comprised of a slurry of a finely divided, particulate refractory material at least the surface of which is a refractory oxide and a solution of a suitable inorganic binder which is capable of being converted to an oxide on being heated;

(b) drying and curing said applied coating by heating same to a temperature below the vitrification temperature of the refractory material but sufficient to convert the binder in situ to an oxide to harden and densify the coating;

(c) impregnating the initial hardened coating with a liquid comprising water; and characterized by:

(d) applying, to the impregnated coating, a second coating layer of a slurry of a finely divided particulate refractory material at least the surface of which is a refractory oxide and a solution of a suitable inorganic binder which is capable of being converted to a water insoluble oxide on being heated;

(e) drying and curing the slurry coating by heating same to a temperature below the vitrification temperature of the refractory oxide but sufficient to convert the chromium compound in situ to a water insoluble oxide; and, (f) repeating the impregnation step (c) before coating, then coating (d) and curing (e) and repeating the impregnating (c), coating (d) and curing (e) steps unitil a desired thickness multiple layered coating is achieved.

* * * * *